US005599428A

United States Patent [19]

Meinecke et al.

[11] Patent Number: 5,599,428

[45] Date of Patent: Feb. 4, 1997

[54] HEADBOX NOZZLE WITH HEAVY END CONVERGENCE

[75] Inventors: Albrecht Meinecke, Heidenheim; Helmut Heinzmann, Bohmenkirch; Wolfgang Ruf, Heidenheim; Dieter Egelhof, Heidenheim; Volker Schmidt-Rohr, Heidenheim, all of Germany

[73] Assignee: J. M. Voith GmbH, Heidenheim, Germany

[21] Appl. No.: 273,808

[22] Filed: Jul. 12, 1994

[30] Foreign Application Priority Data

Jul. 12, 1993 [DE] Germany ..... 43 23 050.4

[51] Int. Cl.[6] ..... D21F 1/02

[52] U.S. Cl. ..... 162/343; 162/344; 162/347

[58] Field of Search ..... 162/343, 344, 162/336, 347

[56] References Cited

U.S. PATENT DOCUMENTS

| | | | |
|---|---|---|---|
| 4,104,116 | 8/1978 | Koskimies | 162/343 |
| 4,221,635 | 9/1980 | Kurtz et al. | 162/343 |
| 4,361,467 | 11/1982 | Dubik et al. | 162/344 |
| 4,384,922 | 5/1983 | Stotz | 162/336 |
| 4,566,945 | 1/1986 | Ewald et al. | 162/343 |
| 4,765,868 | 8/1988 | Fujiwara | 162/343 |
| 4,906,336 | 3/1990 | Weisshuhn et al. | 162/336 |

FOREIGN PATENT DOCUMENTS

| | | | |
|---|---|---|---|
| 2658844 | 6/1978 | Germany | 162/343 |
| 2916251C2 | 2/1987 | Germany | D21F 1/02 |
| 3704462 | 8/1988 | Germany . | |

*Primary Examiner*—Karen M. Hastings
*Attorney, Agent, or Firm*—Baker & Daniels

[57] ABSTRACT

A nozzle of a multilayer headbox wherein the headbox includes a nozzle for distributing the stock suspension on a wire. The nozzle is subdivided by at least one machine-wide fin, the fin forming with the nozzle at least two machine-wide nozzle ducts. At least the mean value of the clearance of at least one nozzle duct diminishes steadily in the flow direction, the percentage decrease of the clearance in the fluidically essential area of the nozzle being at least twice as large as in the starting area of the nozzle. The fin has downstream end area of decreasing thickness immediately preceded by an area of increasing thickness.

6 Claims, 4 Drawing Sheets

HEADBOX NOZZLE WITH HEAVY END CONVERGENCE

BACKGROUND OF THE INVENTION

The invention concerns a multilayer headbox of a paper machine, notably the nozzle of a multilayer headbox. Such a headbox is known, e.g., from DE-OS 37 04 462.

In multilayer headboxes for the production of multilayer papers, the nozzle space is divided across the entire machine width by one or several fins which protrude out of the nozzle. The layers differ normally in the composition of the stock suspension, attempting for instance to produce papers which in their basic structure consist of recycled waste paper while the one-sided or double-sided cover layer consists of high-quality paper material. The stock suspension layers converge at the end of the fin and are dewatered in the follow-on former on or between the sheet formation wire(s). The objective is to produce a product with maximally high purity of layers, that is, without mixing between layers. That is, a paper is meant to be produced, e.g., which in terms of its surface qualities matches newly produced papers while the supporting center layer consists of recycled waste paper.

The installation of fins enlarges the friction surface between the stock suspension and the guide surfaces (fins, duct walls). With the prior headboxes, the turbulence energy becomes, due to friction, so high with increasing jet velocity that individual layers mix ever more heavily in the free jet, thereby affecting the quality of the paper produced. Furthermore, high turbulence gives rise to the possibility of droplets separating from the jet surface and leading, in the sheet formation, to disturbances in the paper.

The problem underlying the invention is to provide a multilayer headbox in which a minimally low mixing of individual layers takes place after or at the issuance out of the headbox nozzle, where it would be advantageous if the tendency for droplet formation at high velocities could as well be reduced.

SUMMARY OF THE INVENTION

This problem is solved by providing the nozzle with a design such that in the fluidically first part it features a relatively low convergence, i.e., that the stock suspension flows in this part also at a relatively low and uniform velocity, whereas the end part of the nozzle tapers heavily, that is, possesses a high convergence, thereby greatly accelerating the stock suspension in this area with the result of a high directional stability of the flow and, thus, low mixing tendencies. In addition, it is desirable, in the context of the invention, also to have the heavily converging part of the nozzle followed by a short, parallel to slightly converging section.

In one form thereof, the nozzle according to the invention comprises at least one machine-wide fin that subdivides the nozzle into at least two machine-wide nozzle ducts, the mean value of the clearance of at least one of the ducts diminishing continuously in the flow direction, wherein the percentage decrease of the clearance in the downstream end of the nozzle is at least twice as large as in the upstream inlet area of the nozzle.

BRIEF DESCRIPTION OF THE DRAWINGS

The invention will be described in detail in the following figures, wherein.

DETAILED DESCRIPTION

Figure 1:
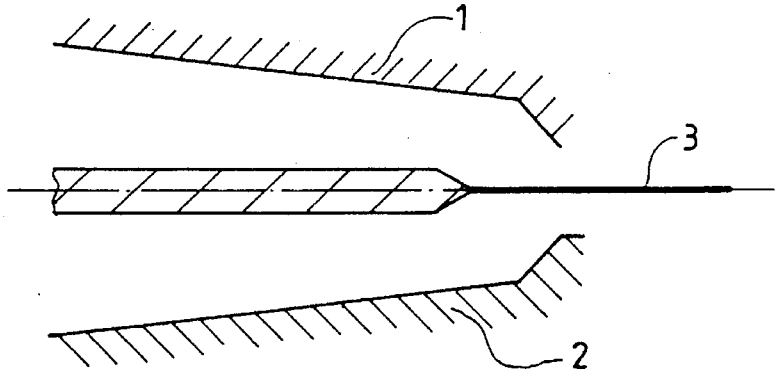
FIGS. 1 through 3, are longitudinal sections through two finned headbox nozzles for two layers.
Figure 2:
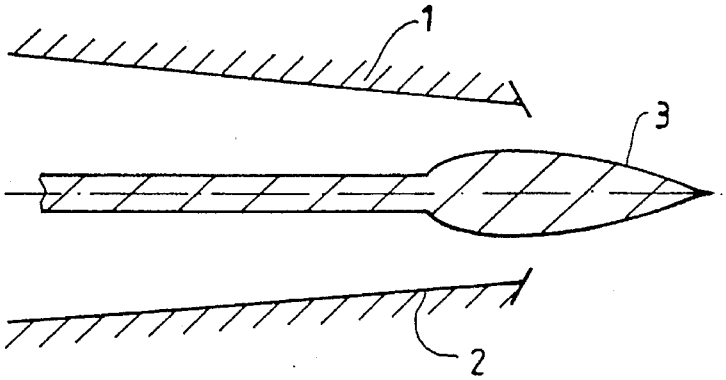
Figure 3:
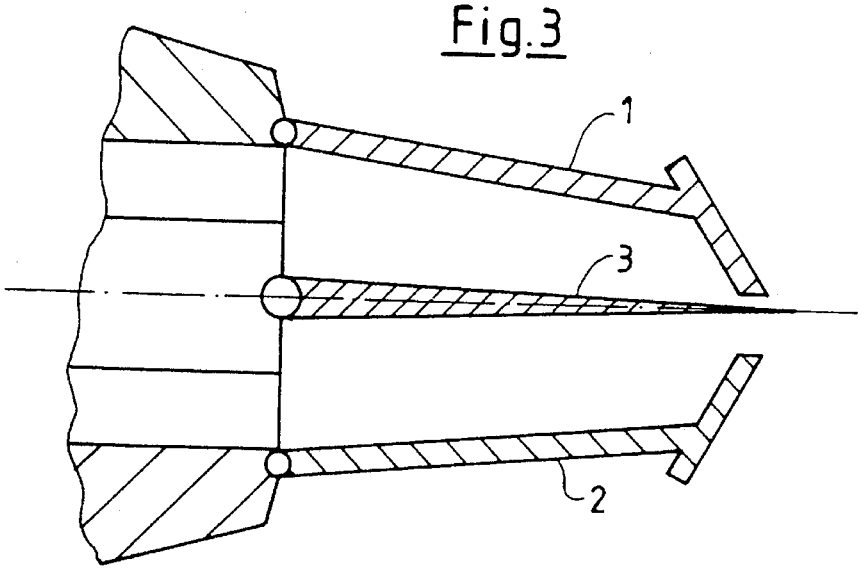

FIGS. 1 through 3 show various embodiments of an inventional two-layer headbox. Depicted is the relevant nozzle part of a headbox with top and bottom walls 1 and 2 of the headbox and an interposed fin 3. In FIGS. 1 and 3, the elevated final convergence in the end area of the nozzle is effected by the angled end area of the top and bottom walls 1 and 2, while in the headbox nozzle illustrated in FIG. 2 the essential part of the elevated final convergence is effected by a shaped fin 3 which widens toward the end of the nozzle and thins out again in the discharge area.

Figure 4:
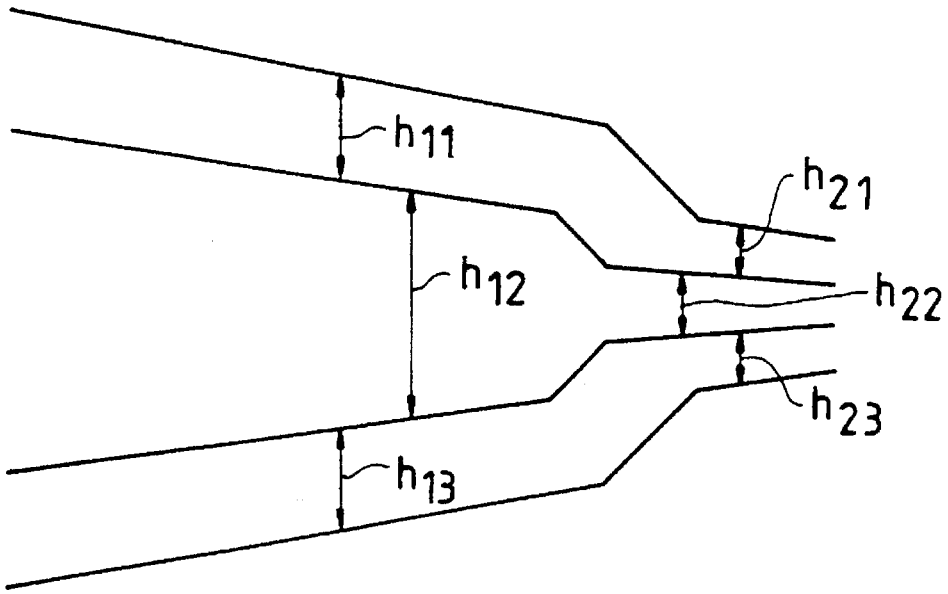
FIG. 4, is a schematic longitudinal section through a headbox with three layers.

FIG. 4 shows schematically as well a cross section through the nozzle area of a three-layer headbox, with the levels $h_{11}$ plotted in a first section and the levels $h_{21}$ plotted in an end area, the applicable condition being $h_{11}>h_{21}$. Existing between these two areas is a short stretch of high convergence in which the distances H of the nozzle walls diminish continuously.

Figure 5:
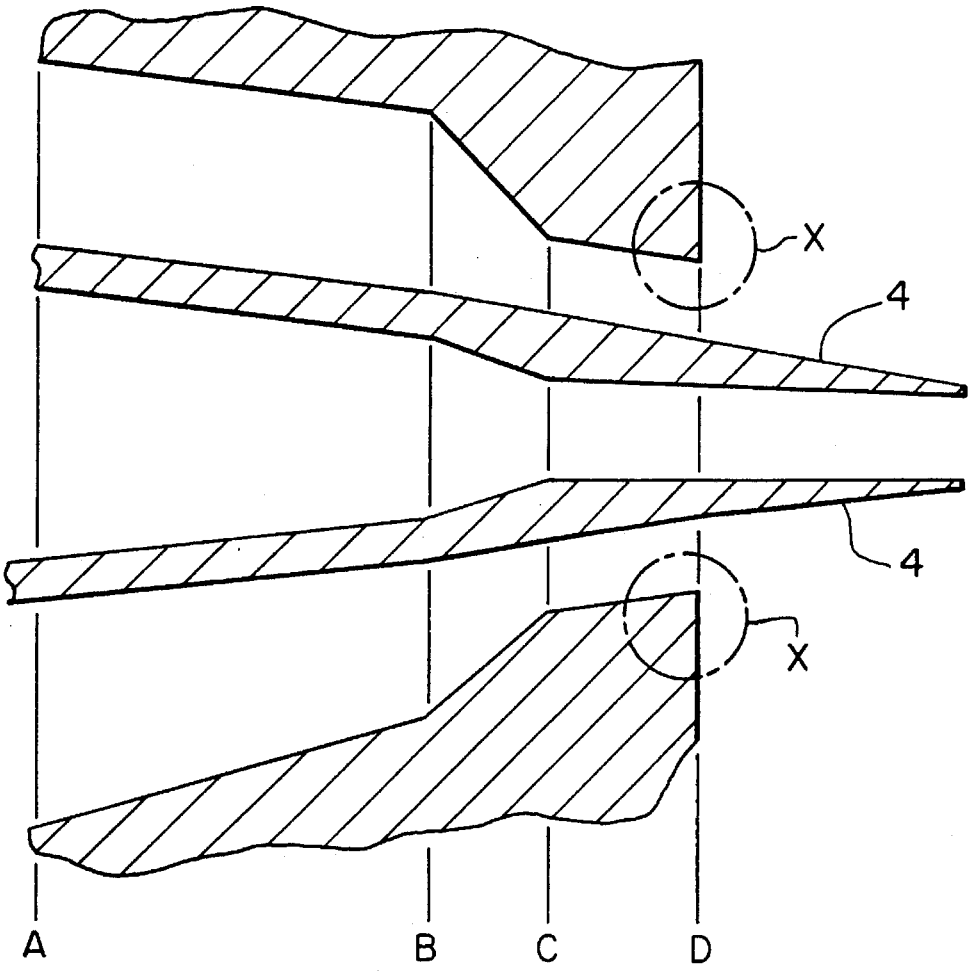
FIG. 5 is a longitudinal section of a three-layer headbox.
Figure 7:
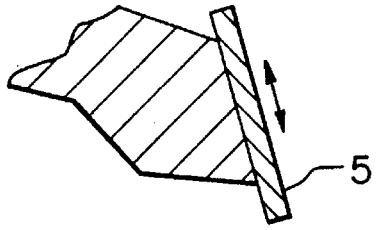
FIG. 7 is an enlarged sectional view of a modification to the area of the nozzle of FIG. 5 identified by the letter X.
Figure 8:
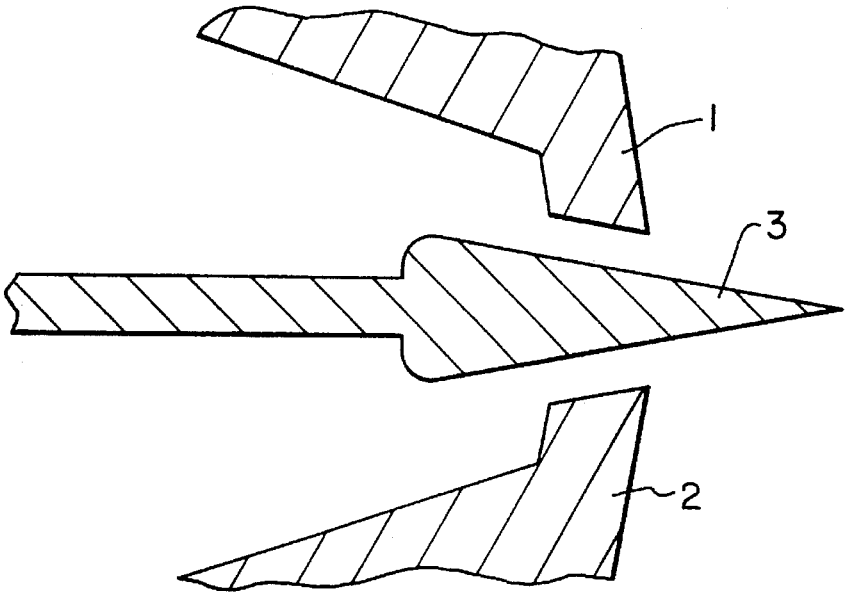
FIG. 8 is a longitudinal sectional view of a nozzle having a non-converging area following a high convergence area.
Figure 9:
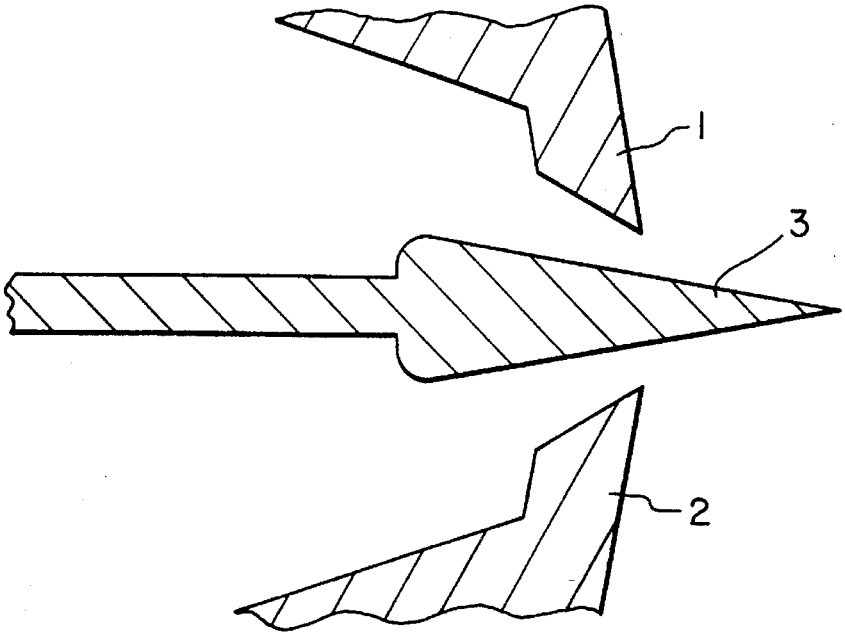
FIG. 9 is a longitudinal sectional view of a nozzle having a low convergence area following a high convergence area.

FIG. 5 shows an embodiment of a headbox nozzle in a three-layer headbox with internal fins 4, in which headbox exists a slight convergence in the area [AB] followed by a strong convergence in section [BC], followed again by a section [CD] of low convergence. Depicted here, as examples, are fins 4 which extend beyond the nozzle. The illustrated section X in FIG. 7 indicates once more that also with this type of headbox a variable aperture setting on the upper, respectively lower, headbox by means of adjustable lip 5 is possible and favorable.

Figure 6:
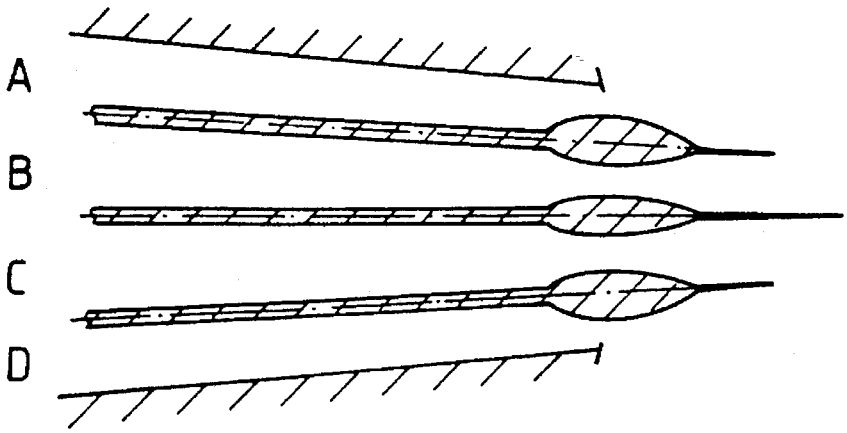
FIG. 6 is a sectional view of an exemplary embodiment of a four-layer headbox.

FIG. 6 shows in exemplary fashion a headbox with four layers, where the illustrated fin shape causes a heavy convergence in the end area here as well.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multi-layer headbox for distributing a stock suspension onto a wire and a paper machine, said headbox including a nozzle having a lower convergence upstream inlet area immediately followed by a higher convergence downstream end area, said nozzle comprising at least one machine wide fin that subdivides the nozzle into at least two machine-wide nozzle ducts, the mean value of the clearance of at least one of said ducts diminishes continuously in the flow direction, the percentage decrease of said clearance in the downstream end area of the nozzle being at least twice as large as the percentage decrease of said clearance in the upstream inlet area of said nozzle, said fin having a downstream end area of decreasing thickness immediately preceded by an area of increasing thickness, only the downstream end area of the fin having a single said area of increasing thickness immediately followed by a single said area of decreasing thickness.

2. The multi-layer headbox according to claim 1 wherein said higher convergence downstream end area of said nozzle is followed by an area of non-converging cross-section.

3. The multi-layer headbox of claim 1 wherein the higher convergence downstream end area of said nozzle is followed by an area of lower convergence.

4. The multi-layer headbox of claim 1, wherein said nozzle has an aperture that is adjustable on one of an inlet or outlet side thereof.

5. The multi-layer headbox of claim 2, wherein said nozzle has an aperture that is adjustable on one of an inlet or outlet side thereof.

6. The multi-layer headbox of claim 3, wherein said nozzle has an aperture that is adjustable on one of an inlet or outlet side thereof.

* * * * *